US006588335B1

(12) United States Patent
Bourrieres et al.

(10) Patent No.: US 6,588,335 B1
(45) Date of Patent: Jul. 8, 2003

(54) CAPILLARY SURFACE INJECTION SQUEEGEE FOR THE SCREEN PRINTING OF LIQUID PRODUCTS AND A WORKING PROCESS FOR SAID SQUEEGEE

(75) Inventors: Francis Bourrieres, Montauban (FR); Clement Kaiser, Montauban (FR)

(73) Assignee: Novatec SA, Montauban (FR)

( * ) Notice: Subject to any disclaimer, the term of this patent is extended or adjusted under 35 U.S.C. 154(b) by 0 days.

(21) Appl. No.: 09/786,115

(22) PCT Filed: Sep. 2, 1999

(86) PCT No.: PCT/FR99/02088

§ 371 (c)(1),
(2), (4) Date: May 18, 2001

(87) PCT Pub. No.: WO00/13904

PCT Pub. Date: Mar. 16, 2000

(30) Foreign Application Priority Data

Sep. 3, 1998 (FR) ..... 98 11005

(51) Int. Cl.[7] ..... B41M 1/12
(52) U.S. Cl. ..... 101/129; 101/123
(58) Field of Search ..... 101/123, 124, 101/125, 327, 333, 129

(56) References Cited

U.S. PATENT DOCUMENTS

| | | | | | |
|---|---|---|---|---|---|
| 1,938,904 | A | * | 12/1933 | Harris | 101/125 |
| 3,570,396 | A | * | 3/1971 | Schwartzman | 101/125 |
| 3,678,848 | A | * | 7/1972 | Roser et al. | 101/125 |
| 3,845,712 | A | | 11/1974 | Lewicki, Jr. | |
| 3,921,521 | A | | 11/1975 | Kudlich | |
| 4,023,486 | A | | 5/1977 | Linthicum et al. | |
| 4,441,422 | A | * | 4/1984 | Dreeben | 101/125 |
| 4,557,620 | A | * | 12/1985 | Hancy | 101/125 |
| 4,622,239 | A | | 11/1986 | Schoenthaler et al. | |
| 4,986,175 | A | * | 1/1991 | Boehringer et al. | 101/125 |
| 5,277,721 | A | * | 1/1994 | Ooms | 101/368 |
| 5,778,776 | A | * | 7/1998 | Fuwa et al. | 101/125 |
| 5,899,142 | A | * | 5/1999 | Suda et al. | 101/125 |

FOREIGN PATENT DOCUMENTS

| | | |
|---|---|---|
| DE | 2250092 | 1/1972 |
| DE | 4330681 | 9/1993 |
| FR | 2754473 | 4/1998 |
| GB | 970301 A | 11/1960 |
| GB | 987719 A | 3/1964 |
| GB | 1433957 | 1/1974 |
| WO | WO 96/20088 | 7/1996 |
| WO | WO 98/16387 | 4/1998 |

OTHER PUBLICATIONS

International Search Report, PCT/FR 99/02088, Nov. 25, 1999.

* cited by examiner

*Primary Examiner*—Ren Yan
(74) *Attorney, Agent, or Firm*—Shanks & Herbert

(57) ABSTRACT

A capillary squeegee and a method utilizing a capillary squeegee for screen printing liquid product onto a substrate through apertures in a printing screen on translation thereover, the squeegee including a capillary element for delivering liquid product from a pressurizable reservoir to a printing screen, wherein the capillary element is configured to provide a flow resistance which is such as to prevent flow therefrom when not pressurized and allow flow therefrom when pressurized; and first and second sealing lips which, during screen printing, both together contact the printing screen, wherein the sealing lips are disposed, in oppositely-inclined relation, to opposed edges of the capillary element in the direction of translation and define a delivery aperture therebetween, the delivery aperture having size suited to the substrate.

13 Claims, 6 Drawing Sheets

CAPILLARY SURFACE INJECTION SQUEEGEE FOR THE SCREEN PRINTING OF LIQUID PRODUCTS AND A WORKING PROCESS FOR SAID SQUEEGEE

This application claims priority to PCT/FR99/02088 filed Sep. 2, 1999 and to FR 98/11005 filed Sep. 3, 1998.

FIELD OF THE INVENTION

The present invention relates to a capillary surface injection squeegee for screen printing liquid products of a viscous liquid under optimum conditions through the openings of a screen printing stencil. This mechanism can be adapted to the object of FR 2754473, or any other existing device with an incorporated reservoir in which a pressure can be adjusted.

DESCRIPTION OF THE PRIOR ART

Conventionally, liquid products are deposited on a surface by spraying, by immersion, or by the use of a brush when there are no complex areas to be protected. Otherwise, that is to say if there are complex areas to be protected, then the screen printing process is used. Firstly, the screen printing process consists of a stencil, or screen printing mask, which is usually made of a piece of synthetic material or stainless steel. This screen printing stencil is produced in such a way that it has blocked areas and open areas corresponding to the patterns to be reproduced. Secondly, the screen printing screen is placed on the surface to be screen printed, and an inclined squeegee which is pressed simultaneously and moved in a direction parallel to the screen forces the liquid product to pass through the open areas of the screen. Squeegees are generally made either of a profile member of more or less hard rubber, or of stainless steel plates. In all cases, the transfer pressure transmitted to the product depends upon the angle which is formed between the plane of the screen and the active face of the squeegee. The smaller the scraping angle, the greater the transfer pressure. As for the masks, these can be made of a woven mesh of stainless steel, polyester, or silk, or even stencil plates. These screens can be either flat, or cylindrical, in the case of continuous screen printing. The screen printing process, as described hereinabove, is a very old process but it has a certain number of disadvantages, such as the rheological changes in the product which is to be transferred during the work, either by the evaporation of solvents contained in the product, or by interaction with the ambient environment. This rheological change is translated by an obligation to readjust working parameters or to replace the altered product by a good quality product.

Another disadvantage is the fact that the transfer pressure applied to the product is difficult to control. Indeed, it is not enough to control the scraping angle since the transfer pressure is interdependent on the scraping speed, on the quantity of product found to the front of the squeegee, and on the rheology of the product which is itself variable while work is being carried out, as explained hereinabove. Furthermore, since the maximum transfer force which can be applied is low, the resulting maximum scraping speed as well as the rate of product flow are also limited.

In order to partly eliminate this lack of control over the transfer pressure, it is possible to use a coating operation which consists in spreading the product uniformly over the surface of the screen, and in thus making it available for the scraping operation strictly speaking. Although this additional operation improves screen printing quality, it has the disadvantage of placing a large surface area of the product in contact with the ambient environment, thereby giving rise to rapid changes in rheology by evaporation of the solvents contained in the product.

In order to correct the problems related to the changes in rheology and poor control of the transfer pressure, a certain number of devices have been proposed. These devices all consist in confining the product to a chamber and in expelling it under pressure through a very narrow distribution slit in contact with the screen.

WO 96/20088 and U.S. Pat. No 4,622,239 describe devices of this type which are suitable for the transfer of pasty products, such as solder pastes. These devices are not used to transfer low to high viscosity liquid products because the sealing provided by the members which delimit the distribution slit is inefficient because it is very wide and therefore each time that the device is removed from the screen, e.g. to change series, the product contained in the device continues to flow out, resulting in significant losses of product.

FR 2754473 proposes another device which has better sealing but in which significant losses of product have also been noted as soon as an attempt is made to transfer liquid products, and in this case as well, the product contained between the sealing elements flows out from the device when it is removed from the screen. The invention described and claimed is also limited to use with pasty products, such as solder pastes.

U.S. Pat. Nos. 3,921,521, 4,023,486, GB 1,433,957 and DE 2250092 also relate to closed transfer devices, which, this time, are dedicated to liquid products, but in these cases too all of these devices have a distribution chamber which is delimited at the bottom by the sealing members which form a narrow slot closed by the printing screen, which means that the product contained inside that chamber flows out when the devices are removed from the screen.

In all the afore-mentioned patents, it is noted that product leaks particularly in the areas of the screen not supported by the substrate, e.g. at the sides when this latter is narrower than the length of the product distribution slit, or even at the start or end of the scraping operation when the screen printed substrate is replaced with a new substrate. All these instances of leakage, irrespective of their cause, are particularly harmful, because not only do they produce significant losses of product; they can also interfere with the quality of the deposits. Indeed, when the product which has been exposed to ambient air happens to be located on the surface of the screen, and is therefore unintentionally transferred onto the substrate during subsequent screen printing, this can cause deposits which lack precision or which are of poor quality. Moreover, excess product on the screen causes prolonged downtime for cleaning, and poses health and safety problems for the staff who come into contact with said products, particularly in the case of highly volatile and hazardous solvent-based inks like toluene.

Within a domain which differs significantly from that of the invention, namely the domain of photo-engraving and/or of flexographic printing, DE 43 30 681 proposes that to coat a product on an impression roller an applicator device is used which comprises a capillary element impregnated with coating product which is in direct and constant contact with the coating roller. The purpose of this capillary element is to provide homogeneous coating of the roller with which it is in contact. Although this device is interesting in its use of an intermediate capillary element it cannot be used within the domain of screen printing because this latter integrates the use of a screen printing screen which is responsible for transferring product properly onto the substrate for screen printing. Furthermore, the main inconvenience of the conventional processes and devices is the difficulty of preventing the product from flowing out when the applicator device is no longer in contact with the screen, if the product is particularly runny.

SUMMARY OF THE INVENTION

The present invention makes it possible for the various problems associated with prior art transfer devices to be remedied.

With respect to the device, according to the present invention, a member called a capillary surface injection member is placed between the closed reservoir containing the product to be transferred and between the screen printing screen in order to form deposits, by screen printing, of a liquid to liquid viscous product on a substrate through the openings in a screen which is resting on said substrate; the liquid product being available in a reservoir which can be pressurised and which is open on the side of the screen by a distribution surface whose dimension is adapted to the width of the substrate onto which the deposit is to be made; said reservoir which is integral with the capillary surface injection squeegee is mounted onto a screen printing machine, and, in conjunction with the pressurisation of the liquid, the reservoir assembly plus the capillary surface injection squeegee is subjected to a relative translatory movement with respect to the screen and is pressed onto this latter.

According to the main feature of the invention, the capillary surface injection squeegee is placed between said reservoir and said surface injection screen, incorporates a capillary element and has a greater or less flow resistance to prevent liquid from flowing out of the reservoir when it is not under pressure, and to allow it to flow out when it is under pressure. Furthermore, still in accordance with this main feature of the invention, said capillary surface injection squeegee is closed over the front portion and rear portion by means of sealing lips which are inclined at opposite angles and which make constant contact with said screen. Moreover, said squeegee is receptive to elastic deformation by the sealing lips thereof and contains an available volume of product which increases when pressure on said capillary surface injection squeegee is relaxed and which decreases when pressure is applied to said injection squeegee.

In conventional transfer members, in order to restrict to a maximum the natural flow of the liquid which is to be distributed, it is necessary to close up the distribution slit as much as possible by means of the lips; because of this, in order to provide a suitable flow it is necessary to increase the pressure on the product considerably, which is harmful locally particularly as far as the working life of the stencil is concerned and with respect to the sealing efficiency.

The invention consists in a means of employing the capillary effect in order to prevent the natural flow of product which is associated with a very wide distribution slit proposed by the squeegee of the invention whereof the very great surface area in contact with the screen printing stencil represents the injection location for reducing the pressure to be applied to the product whilst increasing flow rate.

According to the invention, this capillary surface injection squeegee is resistant to sufficiently fast flow (capillarity) to prevent the product which is to be transferred from flowing out of the device when this latter is removed from the screen printing screen, and to prevent the product from being pressurised. The resistance to flow (capillarity) of the capillary element can be adjusted depending upon the viscosity of the product to be transferred.

In accordance with the invention, the permeability of the capillary surface injection squeegee is consistent with the application requirements, that is to say that the flow rate of the product under pressure through the capillary surface injection squeegee can be adjusted in accordance with the desired rate of screen printing desired, the type of substrate, and the viscosity of the product to be transferred, it being understood that the flow through the capillary surface injection squeegee can also be adjusted by controlling the pressure applied to the product in the reservoir.

In accordance with the invention, the capillary surface injection squeegee has an available product-occupied volume which decreases if the pressure exerted to push the device into contact with the screen increases and which decreases if the force of the pressure is reduced. In this way, the residual liquid located at the distribution surface will be sucked back in by low pressure at the end of the scraping operation or when the device is removed from the stencil.

In accordance with the invention, the capillary surface injection squeegee has over the front and back two sealing lips which are inclined in opposite directions and which are responsible for scraping off excess product and thus confining it to the inside of the device. Additional sealing blocks placed on either side of the device make it possible product leakage at the ends of the capillary surface injection squeegee to be avoided.

In accordance with the invention, the capillary surface injection squeegee is flexible enough to be consistent with variations in height associated with irregularities in the substrate or screen, and thus allows the sealing lips which delimit the distribution surface to carry out their role in scraping out the excess.

It is important to emphasize the parity between the sealing lips and the capillary element which are the main elements of the squeegee according to the invention. This combination between the elasticity of said sealing lips and the volume occupied by the capillary element cannot figure in DE 43 30 681 since the lips described in said document are not elastic and do not change the volume of the capillary element by virtue of their elasticity.

Also, the use of an intermediate capillary element between the product to be screen printed under pressure and the screen printing screen is not a simple adaptation of a known device in a new domain of application but the fruit of studies and research for the purpose of satisfying a need which differs from that of homogeneous coating using an impression roller and which is rather to prevent screen printing product from being lost, or, at least, its initial rheological properties from being lost, by virtue of the integration of a capillary element which holds it in place when pressure on the product is interrupted.

In accordance with another particularly advantageous feature of the invention, said sealing lips which come into contact with said screen and the opening of which determines the injection surface area of the product are receptive to elastic deformation and are connected to said capillary element in such a way that its volume changes depending upon whether pressure is applied, or not, to said capillary squeegee.

Another object of the invention is constituted by the working process of the capillary surface injection squeegee which proposes to use the afore-mentioned features and consists in:

pressing said squeegee onto said screen in such a way that by virtue of the connection of the sealing lips to the capillary element and by virtue of their elasticity, the sealing lips reduce the volume of the capillary element, pressurise the product in such a way that this latter is able to pass through said capillary element, and subject said squeegee to a translatory movement relative to the screen in order to carry out the screen printing of a substrate which is placed underneath the screen, then stopping movement, in eliminating pressure on the product in order that this latter may no longer pass through said capillary element, and interrupting the pressure of said squeegee on said mask in order that by virtue of the connection of the sealing lips to the capillary element and by virtue of their elasticity, the sealing lips increase the volume of the capillary element so that when screen printing is interrupted the low pressure created sucks in the product which is present directly in the vicinity of the injection surface. This ability to create a low pressure by releasing pressure on the squeegee provides a significant improvement with respect to keeping the rheological properties of the product to be screen printed, as well as in preventing the creation of a deposit and wastage of the product.

In accordance with another feature of the invention, the capillary surface injection squeegee constitutes an independent module which can be mounted on a transfer device comprising a reservoir which can be pressurised.

In accordance with another feature of the invention, all components of the capillary surface injection squeegee are chemically resistant to the products used as well as to cleaning solutions which may be used to clean the transfer device.

The description hereinafter gives two embodiments of the invention by way of non-limitative example which are illustrated in the drawings which will allow for a better understanding of it and reveal other advantages and features of the invention.

DETAILED DESCRIPTION OF THE PREFERRED EMBODIMENTS

Figure 1:
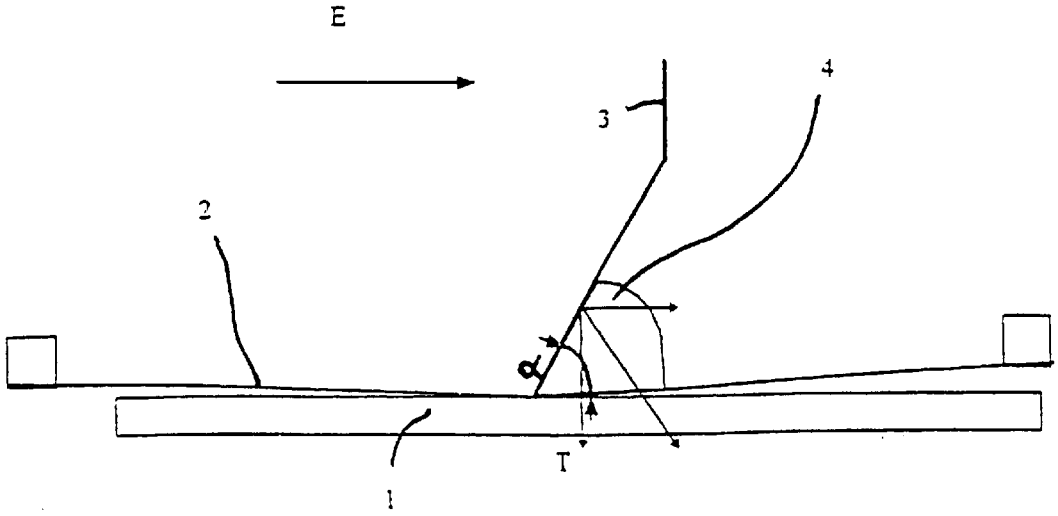
FIG. 1 shows a cross-section of conventional screen printing using a squeegee according to the prior art.

FIG. 1 shows a screen printing application using a squeegee 3 for a product 4 through a screen 2 onto the substrate 1. When the squeegee which is inclined at an angle $\alpha$ in relation to the surface of the substrate moves in the direction E, it transmits a force perpendicular to the edge of the squeegee onto the product whereof the vertical component T, called transfer pressure, alone allows the transfer of product through the screen.

Reducing the angle of inclination $\alpha$ enables the transfer force to be increased, but the maximum value remains low, which at the same time limits the flow rate of product through the screen and therefore the maximum possible screen printing speed. Furthermore, FIG. 1 clearly shows that the product which is on the screen is exposed to the open air and is therefore subject to interaction with the ambient environment, which results in premature ageing of the product and therefore in significant losses of this same product.

Figure 2:
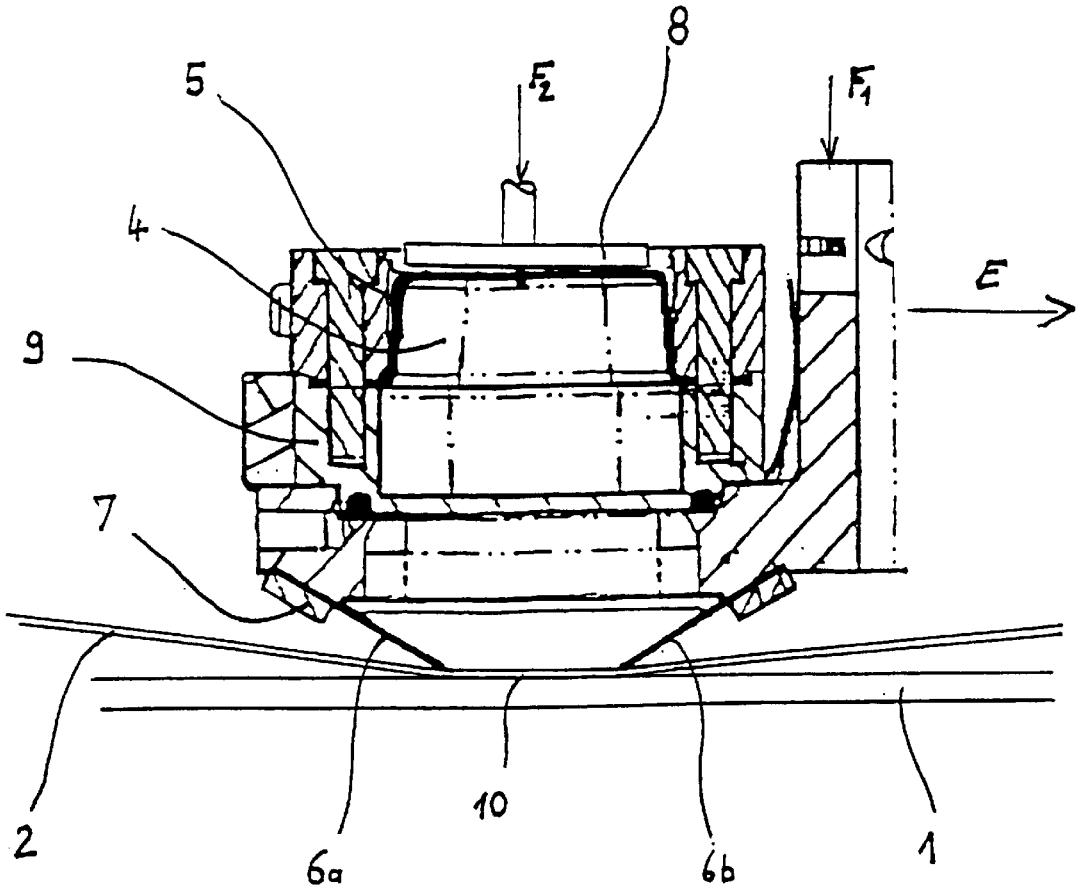
FIG. 2 shows a cross-section of a screen printing device for a paste product according to FR 2754473 by the same inventor.

FIG. 2 shows a direct transfer technique for paste product through a screen invented by the same filer. Here, the product 4 contained in the reservoir constituted by the flexible membrane 5 and the assembly 9 is transferred onto the substrate 1 through the screen 2. The force F1 pushes the device against the mask, and, as a result, it creates a tight contact between the members or sealing lips 6*a* and 6*b* and the screen. The lips are fixed to the assembly 9 by the parts 7. When the device is subjected to relative motion with respect to the screen in the direction E, the transfer force generated by the force F2 on the plunger 8 expels the product 4 through the distribution surface 10 delimited on either side by the lips 6*a* and 6*b*. This type of device is particularly suitable for transferring paste products, such as solder pastes or epoxy glues with a viscosity greater than or equal to 1000 poises.

Indeed, for such great viscosities, the product does not flow naturally from the device even when this latter is removed from the screen, provided that the force F2 on the plunger is nil. On the other hand, this type of device cannot be used for transferring liquid products. Not only is the sealing insufficiently effective at the ends and in the areas where the mask is not held by the substrate, but the product also flows freely from the device either when it is being put in place, or when it is being removed from the screen, or when it is at rest if the lips do not conform exactly to the surface of the screen.

Figure 3:
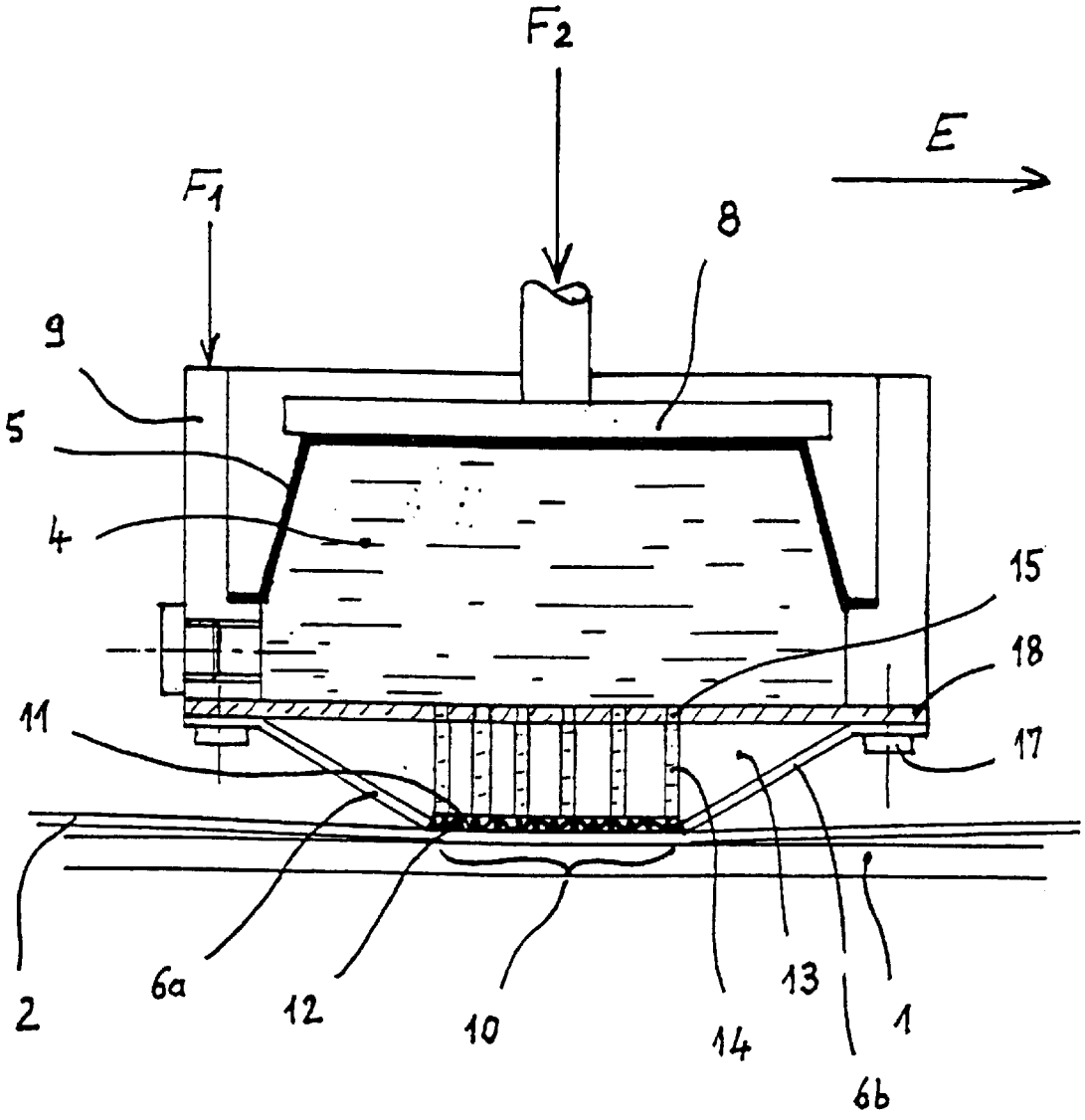
FIG. 3 shows a cross-section of the capillary surface injection squeegee according to the present invention.

FIG. 3 shows an embodiment of the present invention. It consists in placing an autonomous element, called a capillary surface injection squeegee, between the reservoir constituted by the flexible membrane 5 and the assembly 9 containing the product to be transferred and the screen. The capillary surface injection squeegee is fixed to the assembly 9 by means of screws 17. The capillary surface injection squeegee incorporates a capillary element in the form of an elastically deformable profile member 13, e.g. of Rhône Poulenc silicone RTV 71557 and mesh 12 which is attached to the profile member 13 and has product feed openings 14 uniformly distributed in the distribution area 10 which open on the screen side into a countersink 11. The mesh 12 is responsible for making all the openings 14 communicate and for making the pressure of the liquid to be transferred uniform over the entire surface 10 of the screen opposite the countersink. The grid pattern of the mesh 12 can be adjusted as a function of the viscosity of the product to be transferred. Meshes with lower aperture ratios will be selected as the viscosity of the product declines. In all cases, all the openings 14 and the entire mesh 12 have sufficient outflow resistance (capillarity) to prevent the product from flowing freely out of the device when this latter is separated from the screen and when the force F2 is relaxed.

All the orifices 14 and the aperture ratio of the mesh 12 must allow a flow rate of product under pressure in the reservoir which is consistent with the screen printing speed desired and with the type of substrate which is to be printed. Under the effect of the prestress F1, the resilient profile member is crushed so that the sealing members 6*a* and 6*b* which are positioned around the distribution surface 10 can conform to height variations and follow the shape of the screen very closely in order to prevent leakage. This crushing also performs another function. In effect, under the effect of the prestress F1, the volume available inside the capillary surface injection squeegee and occupied by the product 4, determined by the openings 14 and countersink 11, reduces and inversely increases when the prestress is relaxed, as may be the case during downtime or between two screen printings. Consequently, in this second case, the product located at the distribution surface is sucked back into the reservoir and thus cannot escape from the device. The materials for the various components of the capillary surface injection squeegee can be adapted according to their application and their chemical resistance to the product to be transferred. Thus, in order to prevent premature wearing of the stencil or mesh 12 in the case of screen printing screens with silk, polyester or stainless steel meshes, a mesh 12 of the same kind will preferably be selected. The profile member 13 is glued onto a rigid carrier plate 18 which closes the reservoir and which supports the profile member 13 to prevent it from bending in the middle. The plate 18 also has openings 15 through which the product can pass opposite the holes 14 in the profile member 13. The diameter of those openings 15 through which product passes is advantageously calculated and adapted to the viscosity of the product as well as in parity with the size of the cells forming the capillary element.

Figure 4:
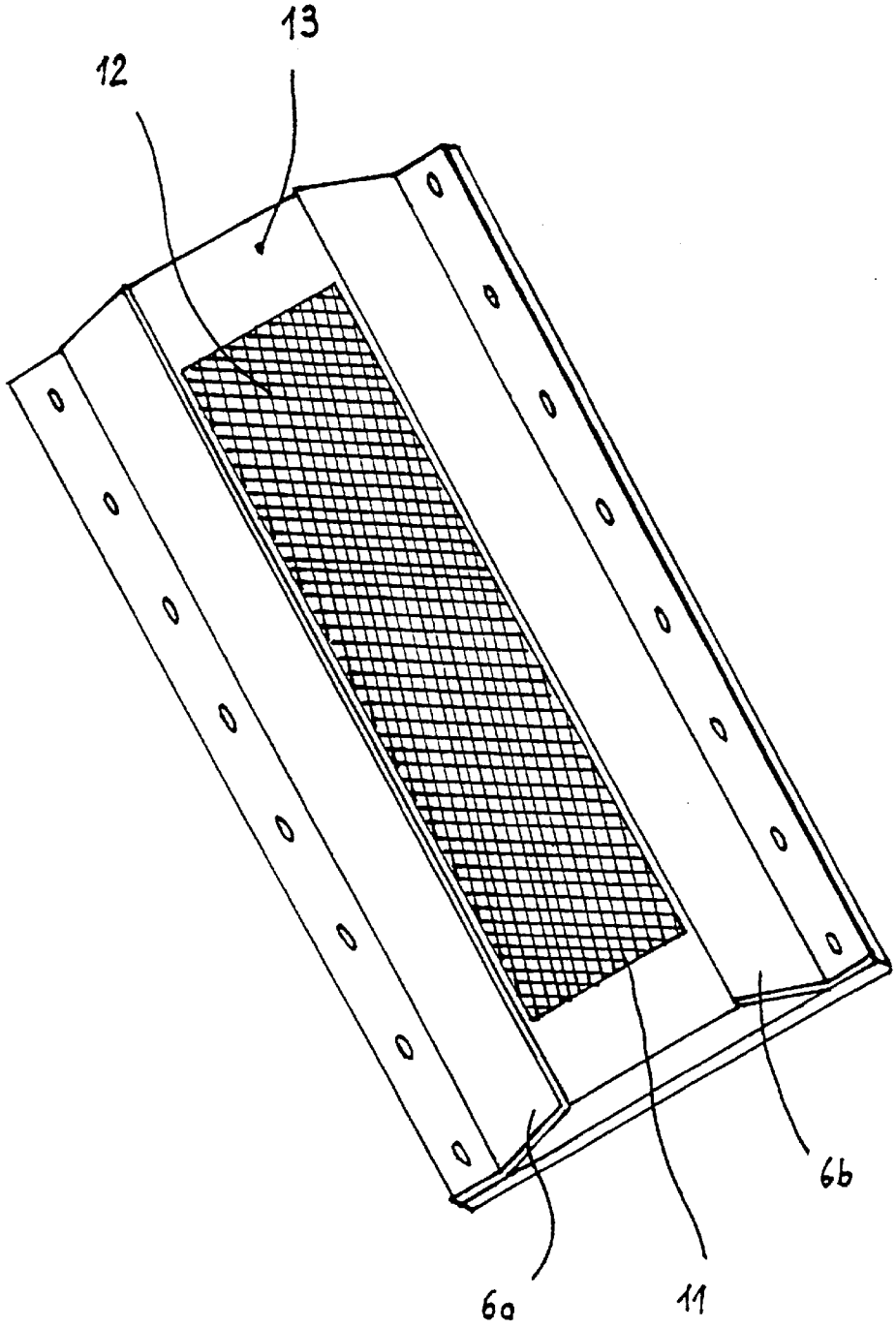
FIG. 4 shows a view in perspective of the capillary surface injection squeegee.

FIG. 4 is a view in perspective of the capillary surface injection squeegee shown in FIG. 3. The countersink 11 which contains the mesh 12 does not extend along the entire length of the capillary surface injection squeegee in order to prevent the product from being able to escape from the two ends. It should be noted that the capillary surface injection squeegee is an independent module which can be mounted on the reservoir of a direct transfer device.

Figure 5:
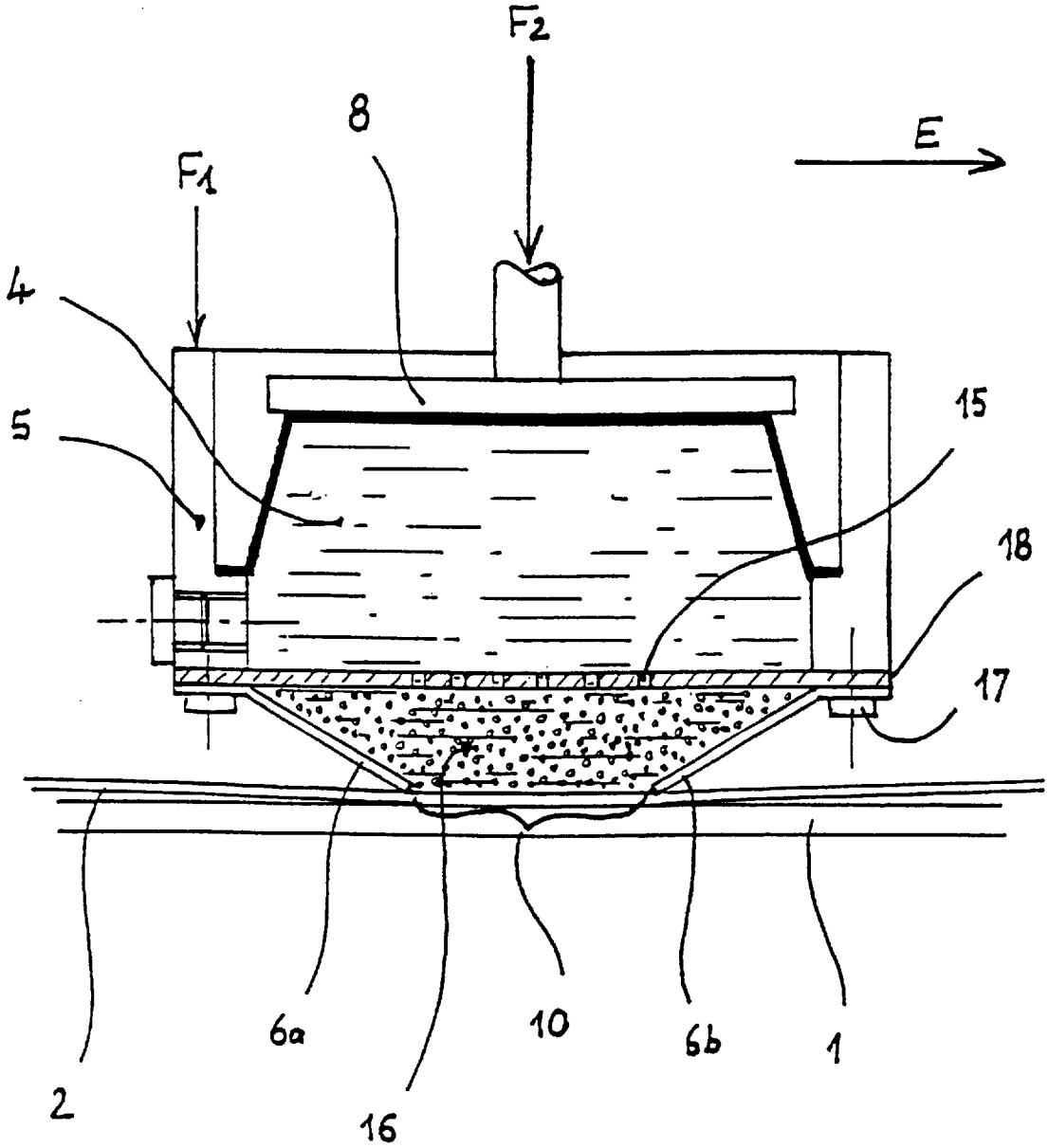

FIG. 5 shows a cross-section of a possible embodiment of the device according to the present invention. In the present instance, the capillary element is constituted by an elastically deformable profile member 16 of open-cell foam, such as polyurethane foam, for example, which has both sufficient permeability to enable the flow of product to be consistent with application requirements when the force F2 is applied to the plunger 8 but also sufficient outflow resistance (capillarity) to prevent the product from flowing freely from the device when this latter is removed from the screen, and when the force F2 is released. As in the previous embodiment of the invention, the volume of the capillary surface injection squeegee which is occupied by the product varies in accordance with the prestress F1 applied to the device, and so when the pressure is released the product located in the vicinity of the distribution surface 10 is sucked back into the device. The foam profile member occupies the entire volume between the lips 6*a* and 6*b* and the support plate 18.

Figure 6:
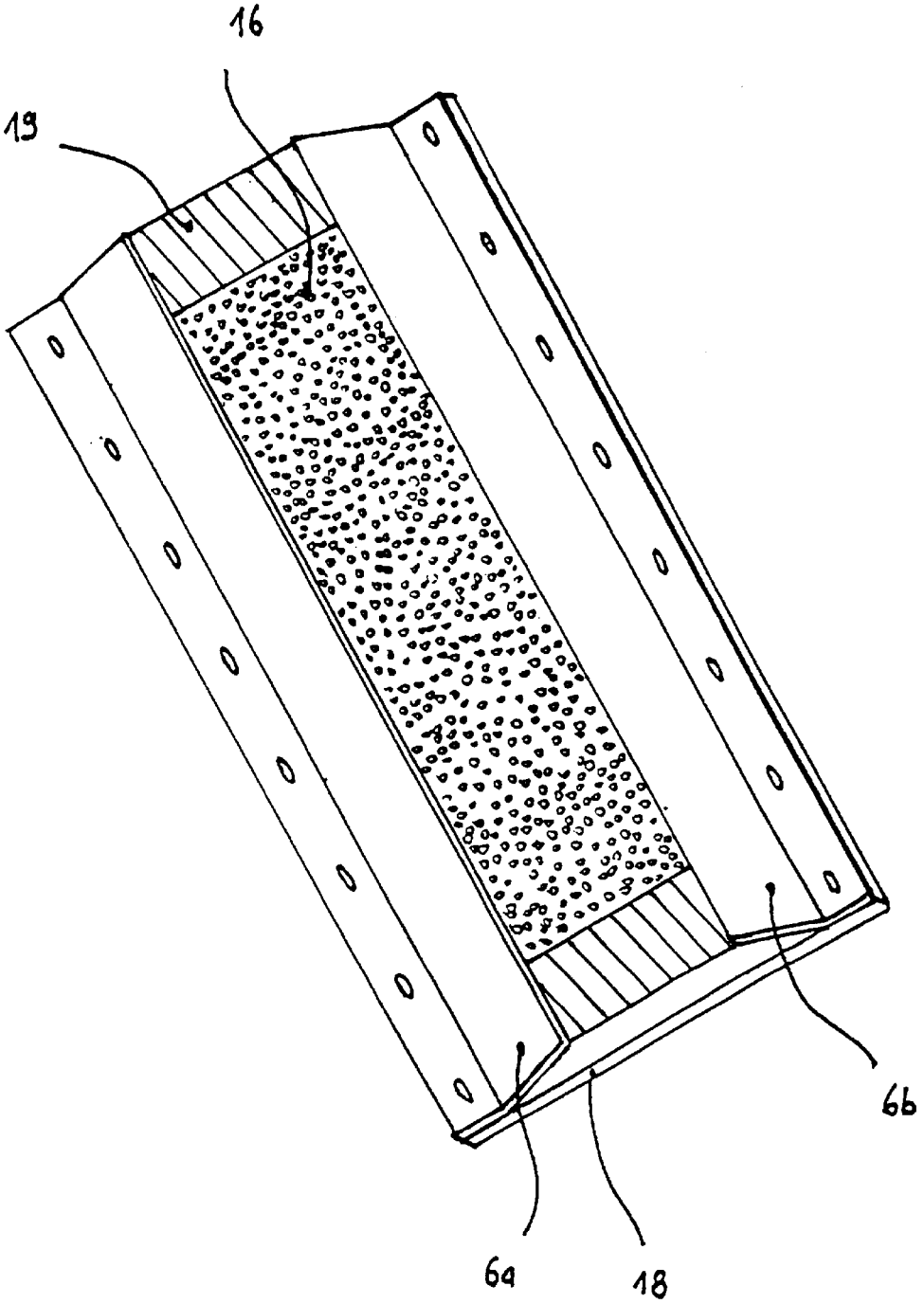
FIG. 6 shows the variant in perspective.

FIG. 6 is a view in perspective of the capillary surface injection squeegee described in FIG. 5. The open-cell foam does not extend across the entire length of the distribution surface in order to prevent lateral product leaks. A profile member 19 of closed-cell foam, e.g. silicone foam or EDPM, is disposed at each end. To prevent any risk of product leakage, the lips 6*a* and 6*b* as well as the support plate 18 are glued to the profile members 19, so that the capillary surface injection squeegee forms an independent interchangeable module. This interchangeability is particularly worthwhile if it is desirable to change the viscosity of the product or the screen printing speed range. In this latter case, it is sufficient to change the capillary surface injection squeegee by selecting a foam with an open-cell dimension suited to the requirements of the new application. Advantageously, it is also possible to take advantage of this interchangeability during cleaning since cleaning can be done when it is not in use if one has two identical capillary surface injection squeegees.

Another way of ensuring that each end of the capillary surface injection squeegee is sealed can be to close up the open cells, e.g. with silicone, which can be poured into the foam in order to fill the cells; in this way, one single foam is needed to produce an injection squeegee.

In certain instances, when the screen and the elastically deformable profile member are of different types, and in order to prevent any premature wear of the foam or screen, it is possible to place a mesh between the profile member and the screen so that the friction of the device on the screen occurs between two materials of the same kind.

The capillary surface injection squeegee is in contact with the screen over the entire surface of the distribution slit, so that the product is not able to accumulate in a pocket which might then empty onto the screen during downtime or when the device is separated from the screen.

The device according to the invention is therefore particularly suitable for rotary or flat screen printing of liquid to viscous liquid products on all sorts of substrates.

By functioning in leak-proof manner, any interaction between the product and external environment is avoided, which therefore increases the life of the products to be transferred and restricts losses. Since the product is always in a closed chamber, including during the phases when the device is separated from the screen, the operators are no longer exposed to it, which considerably improves health and safety conditions. Moreover, since it is able to act independently on the transfer pressure, it follows that the product flow through the capillary surface injection squeegee can be adjusted, i.e. it then becomes possible to increase the screen printing speed considerably.

The device according to the invention can be adapted to existing devices. By way of non-limiting example, it can be adapted to the PROFLOW device which is the trade name of the product which is the object of FR 2754473 which, as a result, considerably increases the possible field of application of this product. This invention will be applicable, notably, in industrial sectors where screen printing is already used for depositing liquid products: printing, poster production, decoration (tiles, enamels, textiles . . . ), the glass industry, automobile industry, etc . . .

Whatever the equipment to which the capillary surface injection squeegee is adapted, the liquid product is disposed in a reservoir which can be pressurised, which is open on the side of the screen by a distribution surface of a size adapted to the width of the substrate on which the deposit is to be made; said reservoir which is integral with the surface injection squeegee is mounted on a screen printing machine, and, in conjunction with the pressurisation of the liquid, the assembly formed by the reservoir which can be pressurised and capillary surface injection squeegee is subjected to relative translatory movement with respect to the screen and is pressed onto that screen.

What is claimed is:

1. A method of screen printing liquid product onto a substrate through apertures in a printing screen, the method comprising the steps of: providing a screen printing device, the screen printing device comprising a pressurisable reservoir for containing liquid product to be screen printed, and a capillary squeegee for screen printing liquid product onto a substrate through apertures in a printing screen on translation thereover, the squeegee comprising a capillary element for delivering liquid product from the reservoir to a printing screen, wherein the capillary element is configured to provide a flow resistance which is such as to prevent flow therefrom when not pressurised and allow flow therefrom when pressurised, and first and second sealing lips which, during screen printing, both together contact the printing screen, wherein the sealing lips are disposed, in oppositely-inclined relation, to opposed edges of the capillary element in the direction of translation and define a delivery aperture therebetween, the delivery aperture having a size suited to the substrate;

lowering the squeegee onto a printing screen above a substrate;

applying a pressure to the liquid product in the reservoir, thereby allowing the flow of liquid product from the capillary element of the squeegee to the surface of the printing screen;

translating the squeegee at least once over the surface of the printing screen;

removing the pressure from the capillary element; and raising the squeegee from the printing screen, with the capillary element of the squeegee preventing flow of liquid product from the reservoir.

2. A capillary squeegee for screen printing liquid product onto a substrate through apertures in a printing screen on translation thereover, the squeegee comprising:

a capillary element for delivering liquid product from a pressurisable reservoir to a printing screen, wherein the capillary element is configured to provide a flow resistance which is such as to prevent flow therefrom when not pressurised and allow flow therefrom when pressurised; and first and second sealing lips which, during screen printing, both together contact the printing screen, wherein the sealing lips are disposed, in oppositely-inclined relation, to opposed edges of the capillary element in the direction of translation and define a delivery aperture therebetween, the delivery aperture having a size suited to the substrate.

3. The squeegee of claim 2, wherein the capillary element comprises a resiliently-deformable member.

4. The squeegee of claim 3, wherein the capillary element further comprises a mesh which is disposed to a lower surface of the resiliently-deformable member.

5. The squeegee of claim 3, wherein the resiliently-deformable member comprises an open-cell foam.

6. The squeegee of claim 5, wherein the lateral ends of the resiliently-deformable member are sealed by a seal.

7. The squeegee of claim 3, wherein the resiliently-deformable member comprises a closed-cell foam which includes a plurality of fluid transfer channels.

8. The squeegee of claim 2, wherein the sealing lips are resiliently deformable.

9. The squeegee of claim 8, wherein the capillary element comprises a resiliently-deformable member and the sealing lips are configured to deform the resiliently-deformable member on deformation of the same.

10. The squeegee of claim 2, wherein the liquid product is a viscous liquid product.

11. A screen printing device, comprising:

the squeegee of claim 2; and a pressurisable reservoir for containing liquid product to be screen printed, wherein the reservoir includes a fluid transfer aperture which is in fluid communication with the capillary element of the squeegee.

12. The device of claim 11, wherein the fluid transfer aperture of the reservoir is in the lower surface thereof.

13. The device of claim 11, wherein the squeegee is separable therefrom.

* * * * *